US005474192A

United States Patent [19]

Hartzell

[11] Patent Number: 5,474,192

[45] Date of Patent: Dec. 12, 1995

[54] LOCKER SHELF SYSTEM

[76] Inventor: Dane E. Hartzell, 1416 W. 34th St., No. 4, Minneapolis, Minn. 55408

[21] Appl. No.: 182,280

[22] Filed: Jan. 18, 1994

[51] Int. Cl.[6] ..... A47F 5/00

[52] U.S. Cl. ..... 211/90; 211/88; 211/106

[58] Field of Search ..... 211/134, 88, 106, 211/186, 90, 13, 69.1

[56] References Cited

U.S. PATENT DOCUMENTS

| | | | |
|---|---|---|---|
| 1,936,517 | 11/1933 | Maine | 211/106 X |
| 2,758,724 | 8/1956 | Schneider | 211/106 X |
| 3,089,597 | 5/1963 | Kaplan | 211/88 |
| 4,475,660 | 10/1984 | Cain | 211/88 X |
| 4,736,853 | 4/1988 | O'Mara | 211/69.1 X |
| 4,779,742 | 10/1988 | Starkweather et al. | 211/13 |
| 4,813,535 | 3/1989 | Radocha et al. | 211/88 |
| 5,221,013 | 6/1993 | Santucci | 211/90 X |

*Primary Examiner*—Robert W. Gibson, Jr.

[57] ABSTRACT

Metal lockers of the type usually found in changing rooms of athletic or swimming facilities typically have a long narrow door with ventilation louvers forming a series of openings there through. Attached via clips or tabs to the inside surface of this door is a double shelf unit that hangs from these louver vents. The frame is made of plastic coated wire. This frame forms two shelves which each hold a removable, portable plastic bin. These bins can be used to tote personal grooming products and the like to and from the shower of lavatory. This shelf system can also be used in the typical school locker for school supplies and such.

5 Claims, 1 Drawing Sheet

LOCKER SHELF SYSTEM

BACKGROUND OF THE INVENTION

The invention relates to organizing attachments for wall lockers. More particularly, this invention relates to a racks and shelves or the like attached to the door of the wall locker used to hold and organize personal effects.

Most lockers in health clubs and such include hooks for hanging clothing towels etc. These hooks are mounted on the inside walls of the locker. In single tier lockers, such as those usually used in schools, one shelf mounted at the upper end of the locker for smaller items. Larger items, like shoes and duffels bags rest on the lower wall of the locker. Unfortunately, there is usually no convenient means to organize small items in the locker, or to transport such items to and from the locker.

School lockers are similarly arranged and appointed. Here to, no convenient system has been provided to organize or transport small items, such as school supplies, grooming aids etc.

BRIEF SUMMARY OF THE INVENTION

Accordingly, it is an object of the subject invention to provide a multiple shelf system that is easily attached to the inside surface of the door of a locker.

It is another object of the invention to provide a system of shelves which support plastic bins with sit on each of the shelves. These bins are portable so that they can be carried with their contents from place to place, but easily replaced into the shelf system.

These portable bins transport their contents to shower/classes without needing to remove the supporting shelf portion attached to the door.

Another aspect of the invention is that the shelf system is easily removable and attachable to the door without damage. It extends well above the vent to make use more convenient. More particularly the shelves, and the bins carried by the shelves, all have rounded shaped to avoid hitting the door jam, and help push clothing hanging in the locker opposite the shelves/bins into the locker to make room for the shelves and bins.

DETAILED DESCRIPTION OF THE PREFERRED EMBODIMENT

Figure 1:
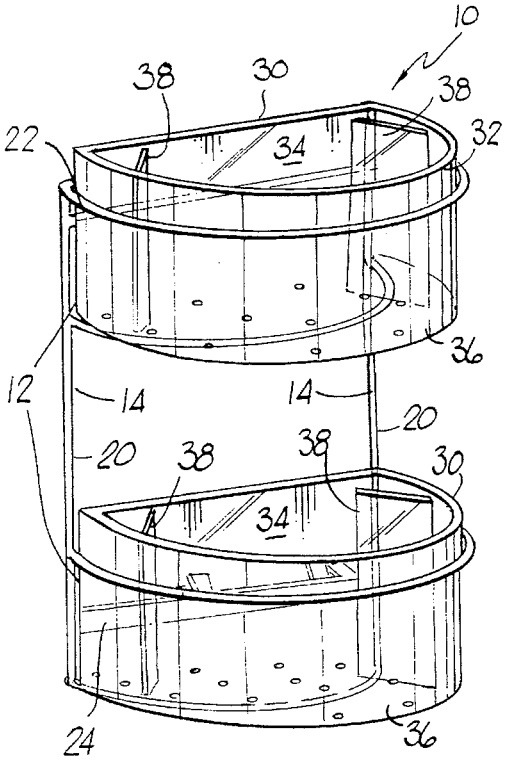
FIG. 1 is a perspective view of the preferred construction of the shelf and bin system according to the invention.

The shelf system 10 comprises a pair of shelves 12 spaced vertically from one another along a frame 14. Each shelf has a bottom wire 16 and a top wire 18. The bottom wire 18 is conveniently formed from a generally semicircular loop of wire fastened at each end to the vertical members 20 of the frame. The top wire 18 is a similarly shaped loop of wire, but having a larger circumference in order to accommodate a bin 30.

Each bin 30 has an overall semicylindrical shape defined by a curving front wall 32, flat back wall 34, and flat bottom 36. Within the thus formed container includes a pair of dividers 38 extending along a diagonal from the back wall to a location on the front wall near the intersection of the rear wall and the front wall. The front and back walls have an overall height above the bottom of about 3¼". The bottom and top ring for each shelf are vertically spaced from one another about 2¾". Thus the bin can rest on the bottom ring 16 while being surrounded by the top ring 18 at its front wall and the frame on the back wall, while the upper edge of the front wall extends above the ring. The bin 30 is securely held to the shelf, but can be easily removed by gripping the upper edge of the front wall and lifting the bin over the upper ring. Since the bottom ring leaves much of the bottom of the bin exposed, one can easily push up on the bottom of the bin to remove it from the rack.

The frame portion 14 of the shelf system comprises at least two vertically extending rods 20 to which the ends of both sets of upper and lower rings are attached, preferably by welding. A single horizontal rod 22 attaches these two vertical rods to one another at their upper end portions. However, there is a bar 24 with two pair of protruding attachment tabs welded to the vertical rods. Preferably, this bar is located near the bottom of the shelf system. As will be detailed, this permits the frame to be attached near the lower edge of the locker door, but extend up from this attachment so the bins carried by the frame can be easily accessed.

Figure 2:
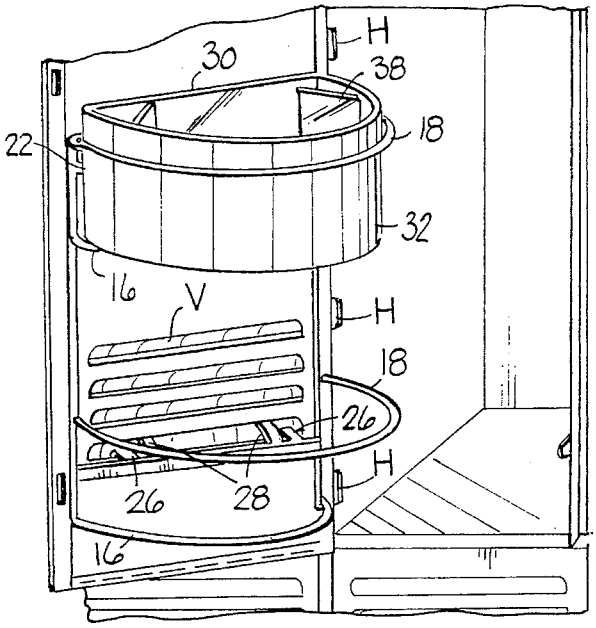
FIG. 2 shows the system of FIG. 2 installed in a typical wall locker.
Figure 3:
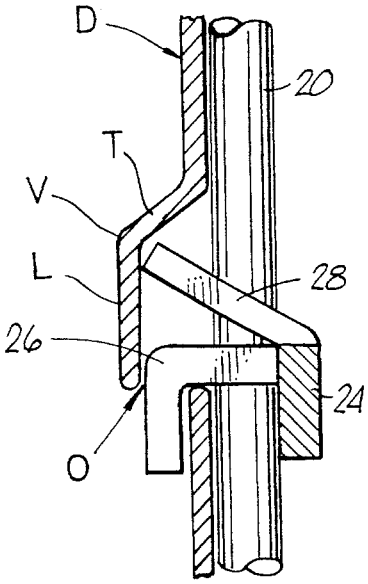
FIG. 3 is a cross sectional view of a part of the installation shown in FIG. 2.
Figure 4:
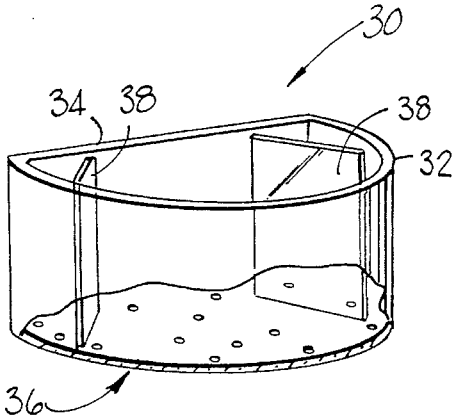
FIG. 4 is a perspective view of a bin for the inventive system.

The structure and operation of the attaching tabs 26 and 28 will now be detailed. Most wall lockers of the type which could best benefit from the this invention have a vertically extending door D made of heavy gage metal. Such a door is shown in FIG. 2 where hinges H arranged along the left edge or the door (right handed doors are also contemplated) permit this tall but narrow door to swing about a vertical axis. Such metal doors almost universally include one or more vents V in the form of outwardly turned louvers. These louvers have a cross sectional shape such as that shown in FIG. 3, such that they have a downwardly facing opening O, a protruding lip L, and a transition portion T which may be defined by sharp corners as shown, although is contemplated that such louvers would have smoother, more rounded contours where the lip and transition portions smoothly blend into one another.

In any event, the attaching tabs on the bar have two basic shapes, there being preferably two pair of each type of tab, each pair being spaced from one another along the bar such that each such pair is arranged close to the vertical rod 20 at the end of the bar 24. Each tab 26 extends horizontally from the bar past the rod 20 a predetermined distance, then bends down sharply to form a bracket which hooks through the louver opening O. the other of the tabs 28 bends out and up from the bar on a diagonal. This tab 28 also extends beyond the rods 20, and projects into the louver, terminating at the juncture between the lip L and transition portion T of the louver.

Installing the shelf system is remarkably simple using the following sequence of steps. First, the bins 30 are removed from the shelves. This permits easy visual and hand access to the rod and tabs, and more importantly permits gentle flexing of the rods 20 if necessary while inserting the tabs into the louver. Initially, the bent tabs 26 are positioned at the louver. The bottom most edge of the frame is pushed firmly against the inside surface of the door below the louver and the upper end of the frame is flexed away from the inside surface of the door. This flexes the rods so that the bent portions of the tabs can be slipped down and out the vent opening and permit the diagonal tabs to pass into position within the protruding portion of the louver. As pressure is released, the frame rods are permitted to straighten out. This places the frame rods flush against the inside of the door, and locks the tabs within the louver so that they can resist unintentionally dislodging the shelf system. This is especially important, since the ends of the bent tabs project slightly out of the vent openings, and from the outside of the closed locker, they are slightly visible to the attentive observer. This may create a temptation to try to dislodge the tabs from the louver by pushing up on the tabs. But this would be quite difficult to accomplish, since the rods will resist such attempts quite well. The rods can be flexed quite easily from the inside as outlined above with regard to proper installation. But such flexing is almost impossible from the outside since the lever arm provided by the perpendicular length of the tab is extremely small relative to the length of the rods.

Once installed, the thoughtful features of the system become even more apparent. The size of the bins, and their easy removal from the nestled location within the outer wire loops help make organizing and transport simple. The rounded shape of the bins and their wire shelves helps prevent interference with the door frame of the locker as the door swings open and closed. The smooth contour helps the bins and shelves push into any hanging clothes in the locker, thus moving the clothes out of the path of the bins to permit the locker door to close, even if the locker is fairly full.

Removing the shelf system is quite easy merely by removing the bins and reversing the installation steps. The locker door is protected from scratching since the metal portions are all heavily covered with a mar resisting thermoplastic coating, preferably applied by fluidized bed dip coating.

I claim:

1. A shelf and bin system for releasable attachment to the door of a wall locker, the door having an inside surface and an outside surface, and a vent for permitting the circulation of air therethrough, the vent including at least one elongated slot, the slot having a first edge and a second edge on the lower side of the slot, the system comprising means for supporting objects including a frame having vertical members and at least one horizontal member attached thereto, means for engaging the inside surface of the door of the wall locker, means for releasably engaging the ventilation slot in the door, the means for releasably engaging the ventilation slot comprising at least a pair of tabs projecting outwardly from the back of the means for supporting, each of the pair of tabs being sized to engage the outside surface of the door through the slot, each of the pair of tabs including a horizontal portion and a downwardly extending portion which is sized to engage the outer surface of the door when the horizontal portion is extended through the slot, the horizontal portion being sized to permit the downwardly extending portion to engage the outer surface of the door only after the vertical members are flexed into a bent position and allowed to resume their unbent shape;

a second pair of tabs bent outwardly from the horizontal member in a generally upward angle from the horizontal member.

2. A shelf and bin system as set forth in claim 1 wherein said means for supporting objects further comprises a shelf comprising a bottom wire and a top wire, said bottom wire formed from a generally semicircular loop of wire fastened at each end to said vertical members, said top wire comprising a similarly shaped loop of wire, but having a larger circumference than said generally semicircular loop of wire forming said bottom wire, at least one bin adapted to be removably supported by said shelf, said bin comprising a back, a bottom, and a semicircular shaped front wherein said bottom of said bin rests on said bottom wire of said shelf when said bin is supported by said shelf.

3. A shelf and bin system for a wall locker comprising at least one shelf supported by a frame, said frame having a pair of vertical members, said shelf comprising a bottom wire and a top wire, said bottom wire formed from a generally semicircular loop of wire fastened at each end to said vertical members, said top wire comprising a similarly shaped loop of wire, but having a larger circumference than said generally semicircular loop of wire forming said bottom wire, at least one bin adapted to be removably supported by said shelf, said bin comprising a back, a bottom, and a semicircular shaped front wherein said bottom of said bin rests on said bottom wire of said shelf when said bin is supported by said shelf.

4. The system of claim 3 wherein said top wire of said shelf embraces said semicircular shaped front of said bin when said bin is supported by said shelf.

5. The system of claim 4 comprising a second similarly shaped shelf supported by said frame and a similarly shaped bin to be supported by said second shelf.

* * * * *